US009609958B1

(12) United States Patent
Roop et al.

(10) Patent No.: US 9,609,958 B1
(45) Date of Patent: Apr. 4, 2017

(54) ALL-TERRAIN BABY WALKER

(71) Applicants: Adam Roop, Macy, IN (US); Allison Roop, Macy, IN (US)

(72) Inventors: Adam Roop, Macy, IN (US); Allison Roop, Macy, IN (US)

( * ) Notice: Subject to any disclaimer, the term of this patent is extended or adjusted under 35 U.S.C. 154(b) by 0 days.

(21) Appl. No.: 15/053,819

(22) Filed: Feb. 25, 2016

(51) Int. Cl.
*A47D 13/04* (2006.01)
*A47C 7/66* (2006.01)
*A47D 15/00* (2006.01)

(52) U.S. Cl.
CPC ..... *A47D 13/043* (2013.01); *A47C 7/66* (2013.01); *A47D 15/00* (2013.01)

(58) Field of Classification Search
CPC ..... A61H 3/008; A47D 13/04; A47D 13/043; A47D 13/046
USPC ..... 280/87.051
See application file for complete search history.

(56) References Cited

U.S. PATENT DOCUMENTS 3,173,396 A 3/1965 Bradov
D295,397 S 4/1988 Brownlie et al.
5,158,319 A 10/1992 Norcia et al.
5,607,376 A * 3/1997 Magid ..... A47D 13/04 482/54
6,142,261 A 11/2000 Yang
6,983,813 B1 1/2006 Wright
7,017,924 B1 3/2006 Lambert
7,249,778 B2 * 7/2007 Scott ..... B62K 3/002 280/266
7,347,432 B2 3/2008 Myers et al.
8,939,455 B1 * 1/2015 Terry ..... B62B 5/0069 180/11
9,033,351 B2 5/2015 Sejnowski et al.
9,192,247 B1 * 11/2015 Lu ..... A47D 13/04
9,357,854 B2 * 6/2016 Sundberg ..... A47D 13/043

* cited by examiner

*Primary Examiner* — Hau Phan
*Assistant Examiner* — Jacob Meyer
(74) *Attorney, Agent, or Firm* — Stevenson IP, LLC

(57) ABSTRACT

A height adjustable all-terrain baby walker including a base with one pair of removable treaded first wheels and one pair of interchangeable treaded wheels and a pair of auxiliary alternate skis interchangeable with the interchangeable wheels via insertion rods which engage receptacles in the base. An upper platform is connected to the base by a pair of stacked interconnected mirror image u-shaped support units. A semicircular seat is disposed on the upper platform. A removable canopy is pivotably disposed on the upper platform and has an adjustable angle relative the upper platform. A plurality of handles disposed on the upper platform with one of the handles being a toy securing member.

8 Claims, 6 Drawing Sheets

ALL-TERRAIN BABY WALKER

BACKGROUND OF THE INVENTION

Various types of child operated walkers are known in the prior art. However, what is needed is an all-terrain baby walker including a base with one pair of fixed treaded wheels and one pair of interchangeable treaded wheels and a pair of auxiliary alternate skis interchangeable with the interchangeable wheels via insertion rods which engage receptacles in the base. An upper platform is connected to the base by a pair of stacked interconnected mirror image u-shaped support units. A semicircular seat is disposed on the upper platform. A removable canopy is disposed on the upper platform and has adjustable angle relative to the upper platform. A plurality of handles is disposed on the upper platform with one of the handles being a toy securing member.

FIELD OF THE INVENTION

The present invention relates to child operated walkers, and more particularly, to an all-terrain baby walker.

SUMMARY OF THE INVENTION

The general purpose of the present all-terrain baby walker, described subsequently in greater detail, is to provide an all-terrain baby walker which has many novel features that result in an all-terrain baby walker which is not anticipated, rendered obvious, suggested, or even implied by prior art, either alone or in combination thereof.

To accomplish this, the present height adjustable all-terrain baby walker is provided with interchangeable transport members, including wheels and a pair of skis, which permit a child to move along a variety of surfaces. The present device includes a parallelepiped base with a pair of removable treaded first wheels and a pair of interchangeable treaded wheels securably disposed on a bottom side thereof proximal a rear side and front side thereof, respectively, attachable via insertion rods vertically protruding therefrom. The tread on the first and interchangeable wheels allows a child to easily move across various types of terrain, rather than on only smooth surfaces as typically permitted by baby walkers.

A plurality of receptacles, centrally disposed on the bottom side between the pair of first wheels and the pair of interchangeable wheels on each of the right side and the left side, receive the insertion rods. A pair of auxiliary alternate skis, to be used on snowy terrain, is interchangeably disposed on the bottom side as an alternate to the interchangeable treaded wheels. A pair of the insertion rod holders is vertically disposed on an inner side of each ski in a position alignable with the pair of receptacles. A pair of the plurality of insertion rods is disposed on an external side of each insertion rod holder. The insertion rods engage the respective pair of receptacles.

A parallelepiped upper platform is attached to the base via a pair of stacked interconnected mirror image u-shaped support units disposed on each of the right wall and the left wall. Each support unit has a pair of lower external edges centrally disposed within the respective channeled guide and a pair of upper external edges is disposed on the respective right wall and left wall of the upper platform. A channeled guide, disposed on the base inner edge on each of a right side and a left side thereof, has a forward end disposed proximal the respective forward receptacle and a rearward end disposed proximal the respective first wheel. A stop member is disposed within each channeled guide at the rearward end. A height adjustment assembly, disposed on the bottom side of the base, engages the lower external edges of the support units within the channeled guides to raise and lower the upper platform.

A semispherical seat section is centrally disposed through the upper platform and has a pair of leg holes. A back rest is disposed on the upper platform proximal the rearward wall and directly adjacent the seat section. U-shaped handles disposed on the upper platform proximal the forward wall assist a child in supporting himself while standing and can also include attachable toys. A removable canopy is pivotably disposed on the upper platform to protect a child sitting or standing in the seat section from sunlight or to be flipped behind the child to allow full sunlight exposure. A pair of removable bumpers is attachable to the bottom side of the base proximal each of the front side, the left side, and the right side and are interchangeably attachable with the skis.

Thus has been broadly outlined the more important features of the present all-terrain baby walker so that the detailed description thereof that follows may be better understood and in order that the present contribution to the art may be better appreciated.

BRIEF DESCRIPTION OF THE DRAWINGS

Figures

DETAILED DESCRIPTION OF THE DRAWINGS

Figure 1:
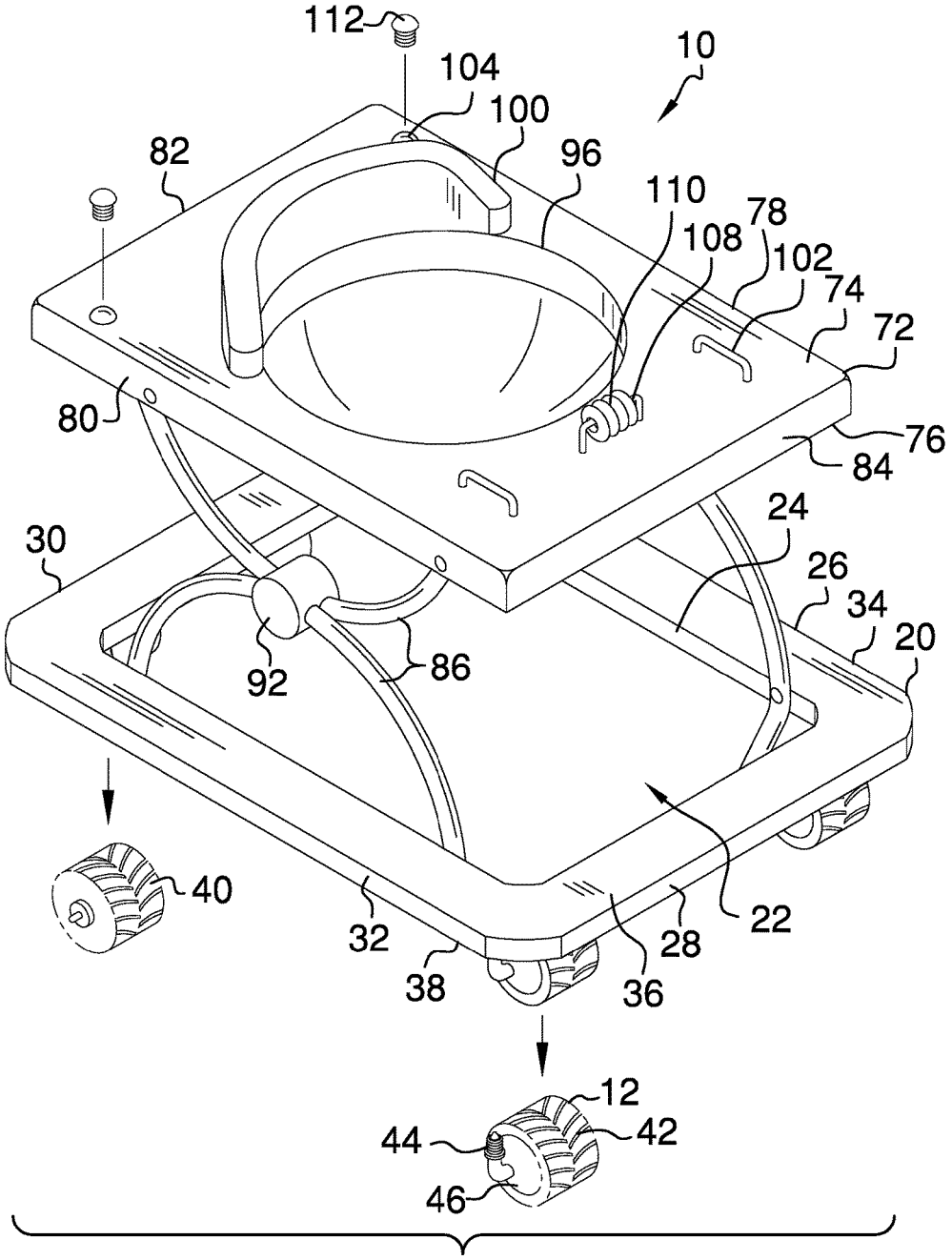
FIG. 1 is an isometric view.
Figure 2:
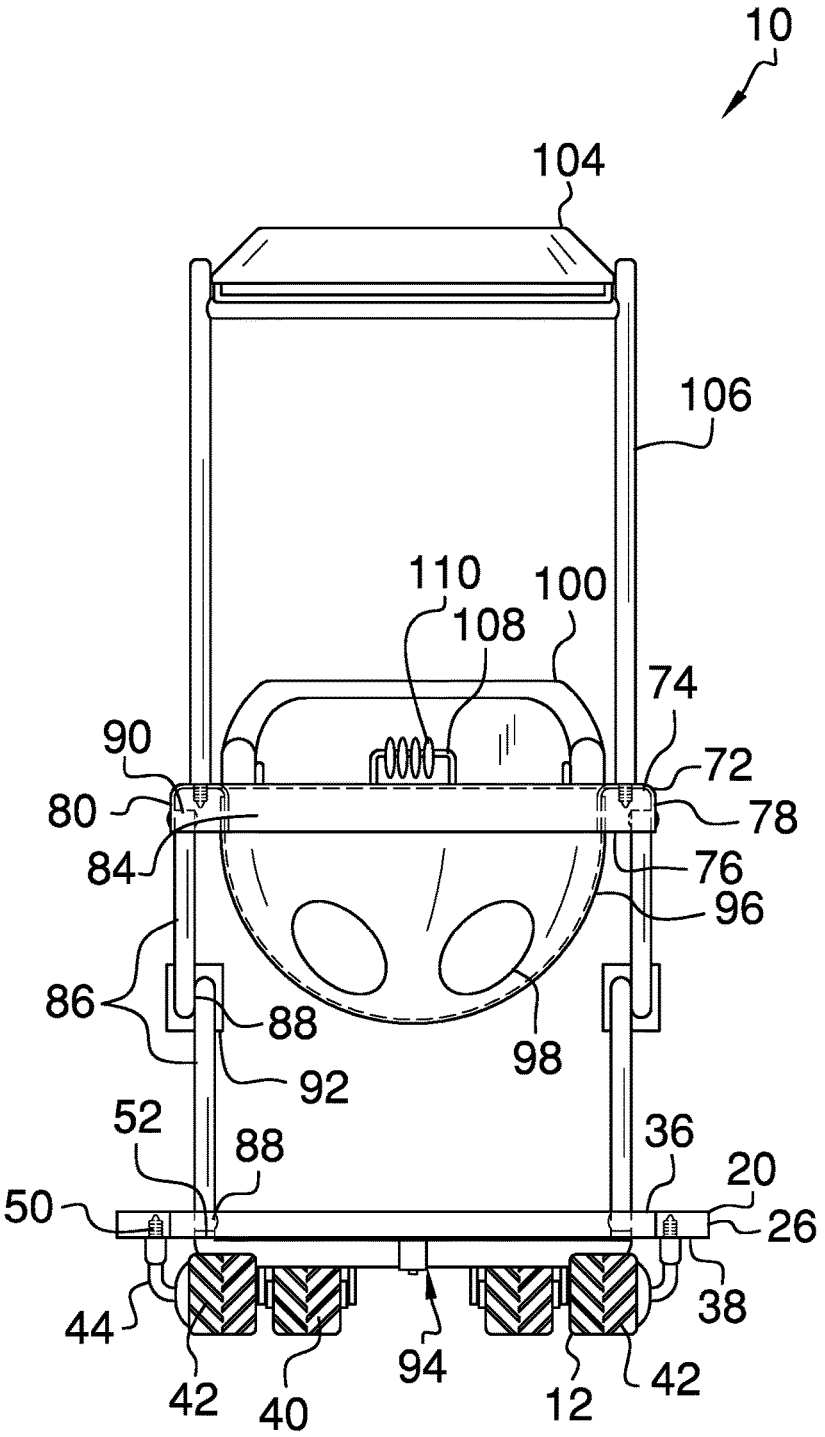
FIG. 2 is a front elevation view.
Figure 3:
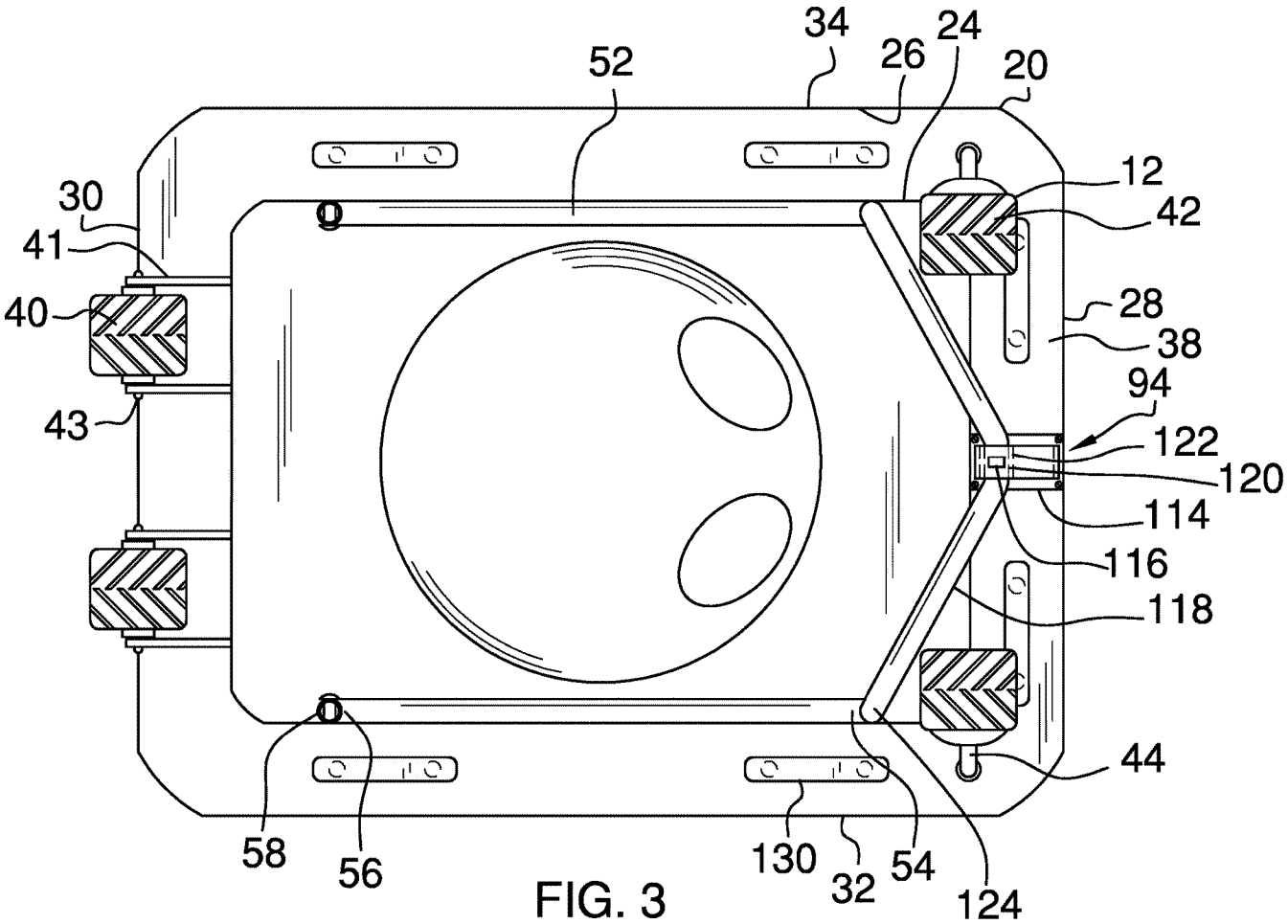
FIG. 3 is a bottom plan view.
Figure 4:
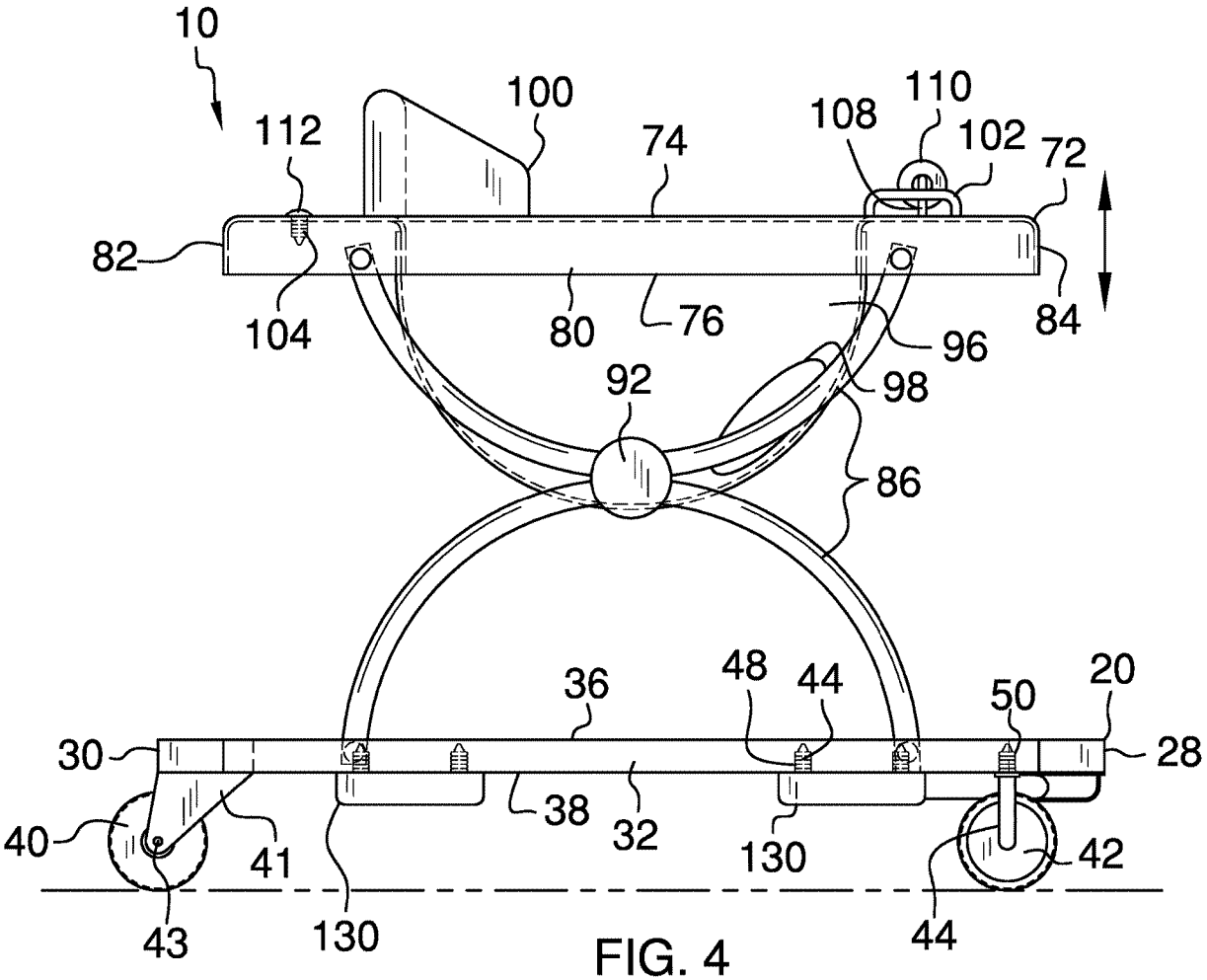
FIG. 4 is a side elevation view.
Figure 5:
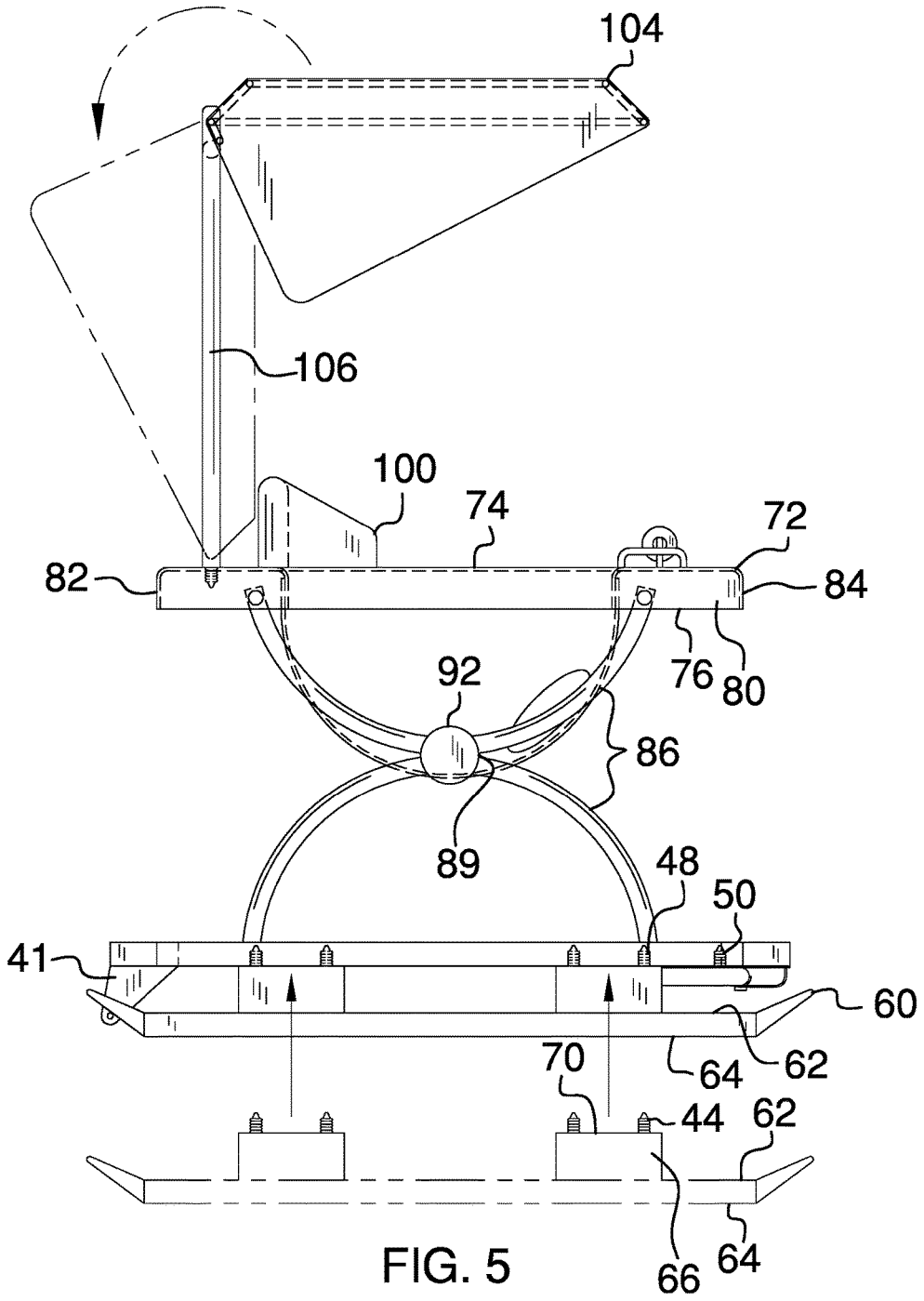
FIG. 5 is a side elevation view showing the attachability of a ski and the pivotability of a canopy.
Figure 6:
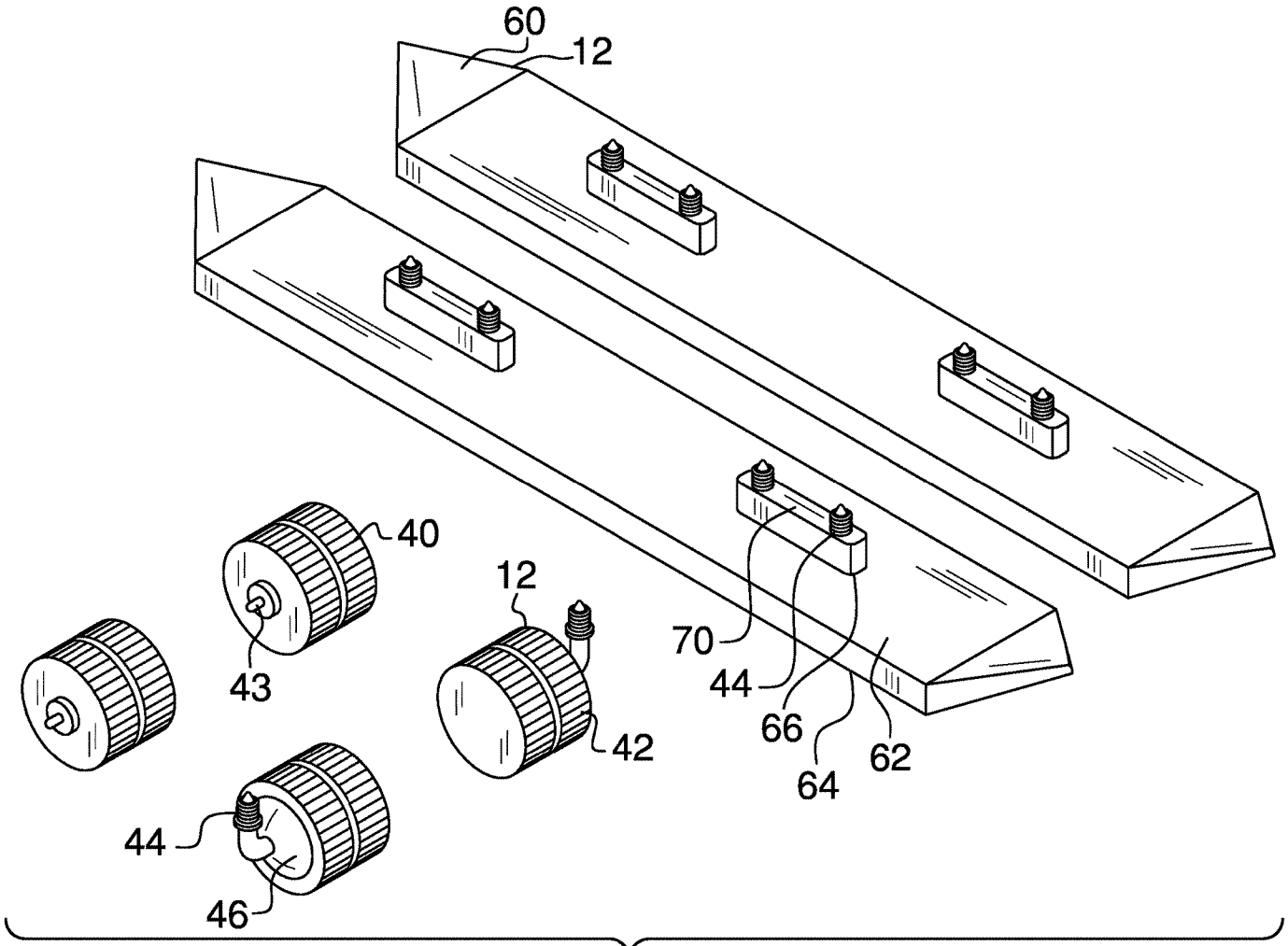
FIG. 6 is a detail isometric view of a pair of treaded wheels and a pair of the skis.

With reference now to the drawings, and in particular FIGS. 1 through 6 thereof, an example of the instant all-terrain baby walker employing the principles and concepts of the present all-terrain baby walker and generally designated by the reference number 10 will be described.

Referring to FIGS. 1 through 6, the present all-terrain baby walker 10 which is provided with interchangeable transport members 12 is illustrated. The all-terrain baby walker 10 includes a parallelepiped base 20 with a hollow center 22, a continuous inner edge 24, a continuous outer edge 26, a front side 28, a rear side 30, a left side 32, a right side 34, an upper side 36, and a bottom side 38. A pair of treaded first wheels 40 is removably disposed on the bottom side 38 proximal the rear side 30. A pair of fixedly disposed brackets 41 is disposed on the bottom side 38. Each of the first wheels 40 is removably attached to the respective bracket 41 via a removable lock pin 43. The interchangeable transport members 12 include a pair of interchangeable treaded wheels 42 is pivotably disposed on the bottom side 38 proximal the front side 28. The present device 10 includes a plurality of insertion rods 44. Each interchangeable wheel 42 has one of the insertion rods 44, which vertically protrudes from an outer side 46 of the interchangeable wheel 42. The interchangeable wheel 42 allows for ease while moving across various types of terrain.

A plurality of receptacles 48 is centrally disposed on the bottom side 38 between the pair of first wheels 40 and the pair of interchangeable wheels 42 on each of the right side 34 and the left side 32. One pair of the plurality of receptacles 48 is proximal each of the first wheels 40 and proximal the interchangeable wheels 42, respectively. A forward receptacle 50 of the plurality receptacles is disposed on the bottom side 38 on each of the right side 34 and the left side 32 proximal the front side 28. The insertion rod 44 of each interchangeable wheel 42 is screwably engageable to the respective forward receptacle 50. A pair of channeled guides 52 is disposed on the base inner edge 24. One guide 52 is disposed on each of the right side 34 and the left side 32. Each guide 52 has a forward end 54 disposed proximal the respective forward receptacle 50 and a rearward end 56 disposed proximal the respective first wheel 40. A stop member 58 is disposed within each channeled guide 52 at the rearward end 56.

Another of the interchangeable transport members 12 is a pair of auxiliary alternate skis 60 interchangeably disposed on the bottom side 38 as an alternate to the interchangeable wheels 42. Auxiliary alternate skis 60 are to be used on snowy terrain. One of the skis 60 is disposed along the respective right side 34 and left side 32. The pair of auxiliary alternate skis 60 has an inner side 62 and an outer side 64. A pair of the insertion rod holders 66 is vertically disposed on the inner side 62 in a position alignable with the pair of receptacles 48. A pair of the plurality of insertion rods 44 is disposed on an external side 70 of each insertion rod holder 66. The insertion rods 44 engage the respective pair of receptacles 48. Each insertion rod holder 66 has a height equal to a height of the first wheel 40 bracket 41.

A parallelepiped upper platform 72 has a top wall 74, a lower wall 76, a right wall 78, a left wall 80, a rearward wall 82, and a forward wall 84. A pair of stacked interconnected mirror image u-shaped support units 86 is disposed on each of the right wall 78 and the left wall 80. Each support unit 86 has a pair of lower external edges 88 centrally disposed within the respective channeled guide 52 and a pair of upper external edges 90 is disposed on the respective right wall 78 and left wall 80 of the upper platform 72. Each of the pair of support units 86 has a single shared apex 89. A cylindrical stabilizer member 92 is disposed on the shared apex 89 of each of the pair of u-shaped support units 86

A height adjustment assembly 94 is disposed on the bottom side 38 of the base 20, wherein the height adjustment assembly 94 engages the lower external edges 88 of the support units 86, and is configured to raise and lower the upper platform 72. A semispherical seat section 96 is centrally disposed through the upper platform 72 and has a pair of leg holes 98. A U-shaped back rest 100 is disposed on the upper platform 72 proximal the rearward wall 82 and directly adjacent the seat section 96. A plurality of spaced apart cylindrical u-shaped handles 102 is disposed on the upper platform 72 proximal the forward wall 84. A single pair of the plurality of handles is disposed in a position parallel to the respective right 78 and left walls 80. A pair of apertures 104 is vertically disposed partially through the upper platform 72 proximal the rearward wall 82, one of the pair of apertures 104 more proximal the right wall 78 and the left wall 80 respectively. The single pair of handles 102 permits a child to support himself while standing. However, at least one of the plurality of handles 102 is a toy-securing member 108 is disposed between the single pair of the plurality of handles 102 in a position parallel to the forward wall 84. A plurality of rings 110 engages the toy-securing member 108.

A removable canopy 105 is disposed on the upper platform. The canopy has a support frame 106, which is pivotably engageable with the pair of apertures 104, which allows the canopy 105 to protect a child sitting or standing in the seat section 96 from sunlight or to allow the canopy 105 to be flipped behind the child to allow full sunlight exposure. A pair of removable plugs 112 is alternately screwably engageable to the pair of apertures 104 when the canopy 104 support frame 106 is removed from the pair of apertures 104.

The height adjustment assembly 94 includes a parallelepiped slide member 114 slidably engages the channeled guides 52 simultaneously. A height adjustment push button 116 is centrally disposed on the slide member 114. Activation of the height adjustment push button 116 permits the slide member 114 to slidingly engage the channeled guides 52 forwardly and alternately rearwardly. A v-shaped arm 118 has a central apex 120 engaging an interior end 122 of the slide member 114 and a pair of external ends 124. Each of the external ends 124 engages the respective channeled guide 52, wherein the sliding engagement of the slide member 114 forwardly and alternately rearwardly engages the external ends 124 within the respective channeled guide 52. The forward and alternate reward engagement of the external ends 124 within the respective channeled guide 52 respectively increases and alternately decreases a distance between the lower external edges 88 of the respective support unit 86, wherein the increase and the alternate decrease in the distance between the lower external edges 88 of the respective support unit 86 lowers and alternately raises the upper platform 72 with respect to the base 20.

A pair of removable bumpers 130 is attachable to the bottom side 38 of the base 20 proximal each of the front side 28, the left side 32, and the right side 34. The bumpers 130 on the left side 32 and the right side 34 have insertion rods 44 and are interchangeably attachable with the skis 60.

What is claimed is:

1. An all-terrain baby walker comprising:

a parallelepiped base having a hollow center, a continuous inner edge, a continuous outer edge, a front side, a rear side, a left side, a right side, an upper side, and a bottom side;

a pair of treaded first wheels removably disposed on the bottom side proximal the rear side;

a pair of fixedly disposed brackets on the bottom side;

a removable lock pin engaging one of each of the first wheels and the respective bracket;

a pair of interchangeable treaded wheels pivotably disposed on the bottom side proximal the front side;

a plurality of insertion rods, each of the interchangeable wheels having one of the plurality of insertion rods protruding vertically from an outer side of the interchangeable wheel thereof;

a plurality of receptacles centrally disposed on the bottom side between the pair of first wheels and the pair of interchangeable wheels on each of the right side and the left side, one pair of the plurality of receptacles being proximal each of the first wheels and proximal the interchangeable wheels respectively, a forward receptacle of the plurality of receptacles disposed on the bottom side on each of the right side and the left side proximal the front side, wherein the insertion rod of each interchangeable wheel is screwably engageable to the respective forward receptacle;

a pair of channeled guides disposed on the base inner edge, one guide disposed on each of the right side and the left side, each guide having a forward end disposed proximal the respective forward receptacle and a rearward end disposed proximal the respective first wheel;

a stop member disposed within each channeled guide at the rearward end;

a pair of auxiliary alternate skis interchangeably disposed on the bottom side, each of the skis being disposed along one of the respective right side and left side, the pair of auxiliary alternate skis having an inner side and an outer side, the pair of auxiliary alternate skis having a pair of parallelepiped insertion rod holders vertically disposed on the inner side in a position alignable with the pair of receptacles, a pair of the plurality of insertion rods disposed on an external side of each insertion rod holder, wherein the insertion rods engage the respective pair of receptacles, wherein each insertion rod holder has a height equal to a height of the first wheel bracket;

a parallelepiped upper platform having a top wall, a lower wall, a right wall, a left wall, a rearward wall, and a forward wall;

a pair of stacked interconnected mirror image u-shaped support units disposed on each of the right wall and the left wall, each support unit having a pair of lower external edges centrally disposed within the respective channeled guide and a pair of upper external edges disposed on the respective right wall and left wall of the upper platform, each of the pair of support units having a single shared apex;

a cylindrical stabilizer member disposed on the shared apex of each of the pair of u-shaped support units;

a height adjustment assembly disposed on the bottom side of the base, wherein the height adjustment assembly engages the lower external edges of the support units, wherein the engagement of the height adjustment assembly to the lower external edges is configured to raise and lower the upper platform;

a semispherical seat section centrally disposed through the upper platform, the seat section having a pair of leg holes;

a U-shaped back rest disposed on the upper platform proximal the rearward wall directly adjacent the seat section; and a plurality of spaced apart cylindrical u-shaped handles disposed on the upper platform proximal the forward wall, a single pair of the plurality of handles being disposed in a position parallel to the respective right and left walls.

2. The all-terrain baby walker of claim 1 comprising:

a pair of apertures vertically disposed partially through the upper platform proximal the rearward wall, one of the pair of apertures more proximal the right wall and the left wall respectively than the other aperture; and a removable canopy removably disposed on the upper platform, the canopy having a support frame pivotably engageable with the pair of apertures.

3. The all-terrain baby walker of claim 1 comprising:

at least one of the plurality of handles being a toy-securing member disposed between the single pair of the plurality of handles in a position parallel to the forward wall; and a plurality of rings engaging the toy-securing member.

4. The all-terrain baby walker of claim 1 wherein the height adjustment assembly comprises:

a parallelepiped slide member slidably engaging the channeled guides simultaneously;

a height adjustment push button centrally disposed on the slide member, wherein activation of the height adjustment push button permits the slide member to slidingly engage the channeled guides forwardly and alternately rearwardly; and a v-shaped arm having a central apex engaging an interior end of the slide member and a pair of external ends, wherein each of the external ends engages the respective channeled guide, wherein the sliding engagement of the slide member forwardly and alternately rearwardly engages the external ends within the respective channeled guide, wherein the forward and alternate rearward engagement of the external ends within the respective channeled guide respectively increases and alternately decreases a distance between the lower external edges of the respective support unit, wherein the increase and the alternate decrease in the distance between the lower external edges of the respective support unit lowers and alternately raises the upper platform with respect to the base.

5. The all-terrain baby walker of claim 1 further comprising:

a pair of removable bumpers attachable to the bottom side of the base proximal each of the front side, the left side, and the right side;

the bumpers on the left side and the right side having insertion rods;

wherein the bumpers on the left side and the right side are interchangeably attachable with the skis.

6. The all-terrain baby walker of claim 2 comprising:

a pair of removable plugs alternately screwably engageable to the pair of apertures when the canopy support frame is removed from the pair of apertures.

7. An all-terrain baby walker comprising:

a parallelepiped base having a hollow center, a continuous inner edge, a continuous outer edge, a front side, a rear side, a left side, a right side, an upper side, and a bottom side;

a pair of treaded first wheels removably disposed on the bottom side proximal the rear side;

a pair of fixedly disposed brackets on the bottom side;

a removable lock pin engaging one of each of the first wheels and the respective bracket;

a pair of interchangeable treaded wheels pivotably disposed on the bottom side proximal the front side;

a plurality of insertion rods, each of the interchangeable wheels having one of the plurality of insertion rods protruding vertically from an outer side of the interchangeable wheel thereof;

a plurality of receptacles centrally disposed on the bottom side between the pair of first wheels and the pair of interchangeable wheels on each of the right side and the left side, one pair of the plurality of receptacles being proximal each of the first wheels and proximal the interchangeable wheels respectively, a forward receptacle of the plurality of receptacles disposed on the bottom side on each of the right side and the left side proximal the front side, wherein the insertion rod of each interchangeable wheel is screwably engageable to the respective forward receptacle;

a pair of channeled guides disposed on the base inner edge, one guide disposed on each of the right side and the left side, each guide having a forward end disposed proximal the respective forward receptacle and a rearward end disposed proximal the respective first wheel;

a stop member disposed within each channeled guide at the rearward end;

a pair of auxiliary alternate skis interchangeably disposed on the bottom side, each of the skis being disposed along one of the respective right side and left side, the pair of auxiliary alternate skis having an inner side and an outer side, the pair of auxiliary alternate skis having a pair of parallelepiped insertion rod holders vertically disposed on the inner side in a position alignable with the pair of receptacles, a pair of the plurality of insertion rods disposed on an external side of each insertion rod holder, wherein the insertion rods engage the respective pair of receptacles, wherein each insertion rod holder has a height equal to a height of the first wheel bracket;

a parallelepiped upper platform having a top wall, a lower wall, a right wall, a left wall, a rearward wall, and a forward wall;

a pair of stacked interconnected mirror image u-shaped support units disposed on each of the right side and the left side, each support unit having a pair of lower external edges centrally disposed within the respective channeled guide and a pair of upper external edges disposed on the respective right wall and left wall of the upper platform, each of the pair of support units having a single shared apex;

a cylindrical stabilizer member disposed on the shared apex of each of the pair of u-shaped support units;

a height adjustment assembly disposed on the bottom side of the base, wherein the height adjustment assembly engages the lower external ends of the support units, wherein the engagement of the height adjustment assembly to the lower external ends is configured to raise and lower the upper platform;

a semispherical seat section centrally disposed through the upper platform, the seat section having a pair of leg holes;

a U-shaped back rest disposed on the upper platform proximal the rear wall directly adjacent the seat section;

a plurality of spaced apart cylindrical u-shaped handles disposed on the upper platform proximal the front wall, a single pair of the plurality of handles being disposed in a position parallel to the respective right and left walls;

a pair of apertures vertically disposed partially through the upper platform proximal the rear wall, one of the pair of apertures more proximal the right wall and the left wall respectively than the other aperture;

a removable canopy removably disposed on the top portion, the canopy having a support frame pivotably engageable with the pair of apertures;

at least one of the plurality of handles being a toy-securing member disposed between the single pair of the plurality of handles in a position parallel to the front wall; and a plurality of rings engaging the toy-securing member;

a pair of removable plugs alternately screwably engageable to the pair of apertures when the canopy support frame is removed from the pair of apertures;

a pair of brackets disposed on the bottom side of the base proximal the front side, the brackets being parallel to each other and to the right and left sides;

a pair of channels centrally disposed within each bracket;

wherein the height adjustment assembly comprises:

a parallelepiped slide member slidably engaging the channels simultaneously;

a height adjustment push button centrally disposed on the slide member, wherein activation of the height adjustment push button permits the slide member to slidingly engage the channels forwardly and alternately rearwardly; and a v-shaped arm having a central apex engaging an interior end of the slide member and a pair of external ends, wherein each of the external ends engages the respective channeled guide, wherein the sliding engagement of the slide member forwardly and alternately rearwardly engages the external ends within the respective channeled guide, wherein the forward and alternate rearward engagement of the external ends within the respective channeled guide respectively increases and alternately decreases a distance between the lower external edges of the respective support unit, wherein the increase and the alternate decrease in the distance between the lower external edges of the respective support unit lowers and alternately raises the upper platform with respect to the base.

8. The all-terrain baby walker of claim 7 further comprising:

a pair of removable bumpers attachable to the bottom side of the base proximal each of the front side, the left side, and the right side;

the bumpers on the left side and the right side having insertion rods;

wherein the bumpers on the left side and the right side are interchangeably attachable with the skis.

* * * * *